United States Patent [19]

Izushi

[11] 4,090,714

[45] May 23, 1978

[54] ROPE CONTROLLED PHOTO TARGET

[75] Inventor: Takehiro Izushi, Kyoto, Japan

[73] Assignee: Nintendo Co., Ltd., Kyoto, Japan

[21] Appl. No.: 780,831

[22] Filed: Mar. 24, 1977

[30] Foreign Application Priority Data

Mar. 24, 1976 Japan ..... 51-36243[U]

[51] Int. Cl.[2] ..... F41J 5/02

[52] U.S. Cl. ..... 273/101.1; 273/105.6; 273/102.1 E

[58] Field of Search ..... 273/101.1, 102.1 R, 273/102.1 E, 1 E, 102 AP, 105.6

[56] References Cited

U.S. PATENT DOCUMENTS

| | | | |
|---|---|---|---|
| 722,220 | 3/1903 | Finney | 273/105.6 |
| 1,324,189 | 9/1919 | Brehmer | 273/101.2 |
| 1,341,814 | 6/1920 | Mosby | 273/102.1 E |
| 2,161,012 | 6/1939 | Breitenstein et al. | 273/101.1 |
| 2,218,772 | 10/1940 | Sowin | 46/119 |
| 2,427,010 | 9/1947 | Lohr | 273/105.6 |
| 4,032,146 | 6/1977 | Kim | 273/105.6 |

*Primary Examiner*—Richard C. Pinkham

*Assistant Examiner*—Lawrence E. Anderson

*Attorney, Agent, or Firm*—Koda and Androlia

[57] ABSTRACT

A light shooting apparatus for amusement including a target structure with a photoelectric sensitive element and a light emitting gun, whereby, upon a successful shooting, a light beam enters into the photoelectric sensitive element from which a signal is generated to effectuate a control circuit so as to cause the target structure to fall down and display a "hit". The target structure comprises; a target assembly including at least one supporting segment and at least one target object, said supporting segment having longitudinal through-hole through which a rope is passed and said target object being provided with a photoelectric sensitive element, whereby the target object takes a standing position when the rope is in a tight state but takes a fell-down position when the rope is loosened; a rope pulling device which keeps a rope tight; and a control device for controlling said rope pulling device, whereby the rope is loosened in response to an output signal from the photoelectric sensitive element of the target segment.

6 Claims, 8 Drawing Figures

ROPE CONTROLLED PHOTO TARGET

BACKGROUND OF THE INVENTION

1. Field of the Invention

This invention relates to a light shooting apparatus of a type wherein a shooting is carried out with a light beam aiming at a shooting target having a photoelectric sensitive element. More particularly, this invention relates to a target structure in light emitting shooting apparatus for amusement, wherein upon a successful shooting of a target object with a light emission gun, a "hit" is indicated by the change of the position of a target object.

2. Prior Art

In the conventional apparatus of this type, a target object falls only in a certain fixed manner and direction upon a successful shooting and this is considered to be rather monotonous.

SUMMARY OF THE INVENTION

Accordingly a primary object of the present invention is to provide a ligt emitting apparatus which is more entertaining by giving versatility to the changes of the position of a target structure upon a successful shooting, for example, falling forward, backward or sideways.

DETAILED DESCRIPTION OF THE INVENTION

Figure 1:
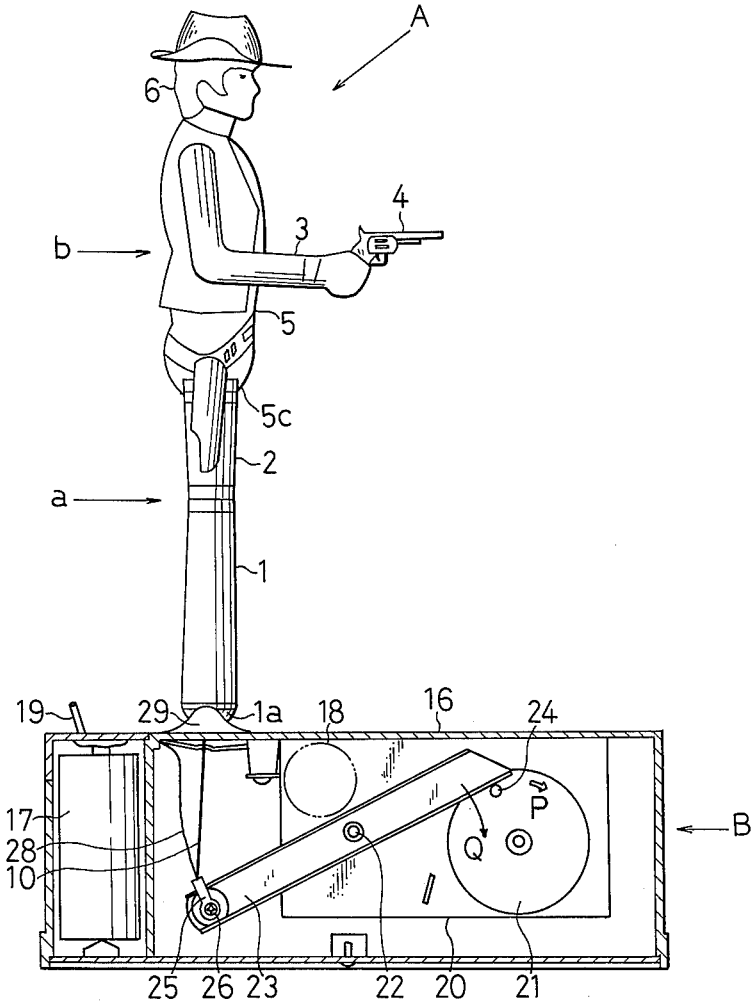
FIG. 1 is a side elevation of a target device in accordance with the present invention.

Characteristics of the present invention will be better understood from the following description made with reference to embodiments and the accompanying drawings.

In the drawing, a target assembly (A) comprises a pair of supporting segments (*a*), each one of them consisting of the first leg portion 1 and the second leg portion 2, and a target segment (*b*) consisting of a trunk portion 5 supported by both leg portions 1, 2, and arm portion 3 with its base portion pivotally secured to the trunk portion 5 and with a pistol 4 at its one end and a head portion 6 supported movably (in right and left directions) by a ball 5*a* formed at a top end of an upper extension of the trunk 5. The target assembly (A) has a shape of a gunman (marksman).

Figure 2:
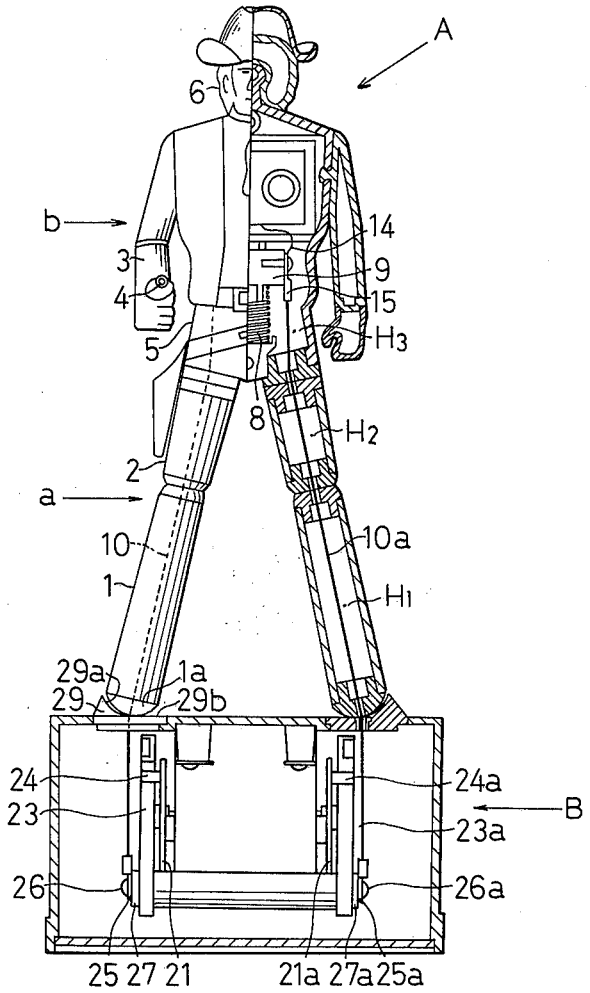
FIG. 2 is a front view of the target device, partly broken away, shown in FIG. 1.
Figure 3:
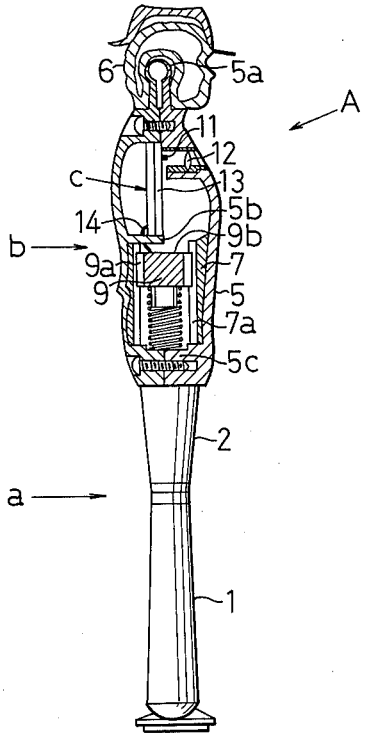
FIG. 3 is a vertical section of a part of the target device shown in FIG. 1.

Referring to the internal construction of the aforementioned target assembly (A) as shown in FIG. 2 and FIG. 3, a pair of guide members 7 (one at the central part of the front and the other at the central part of the rear, opposite to each other) are enclosed in the lower half part of the interior space $H_3$ of the trunk 5. A guide groove 7*a* is formed longitudinally at the central part of the guide member. A movable body 9 is inserted into the guide member 7, with a protruding piece 9*a* engaged with the guide groove 7*a*. A compressible spring 8 is interposed between the movable body 9 and a bottom wall 5*c* to make the movable body 9 vertically movable in the guide member 7 and to bias the movable body 9 upward so that the upper surface 9*b* of the movable body 9 is urged to contact with an intermediate wall 5*b* of the trunk 5.

The first leg portion 1 and the second leg portion 2 constituting the supporting segment (*a*) are provided with a hollow to form through-holes $H_1$, $H_2$ longitudinally. A wire rope 10 is passed through the holes $H_1$, $H_2$. A terminal plate 15 welded to the upper end of said wire rope 10 is fixed to the protruding piece 9*a* of the movable body 9. Thus, the wire rope 10 and the movable body 9 are connected to each other. By pulling the wire rope 10 downward, the movable body 9 is lowered against the compressible spring 8 and the wire rope 10 is put in a tight state, whereby the first leg body 1, the second leg body 2 and the trunk body 5 press each other in vertical direction in such a fashion that joints of segments are on a straight line and are kept in an upright state.

The trunk body 5 of the target segment (*b*) is provided with a base plate 13 at the inner space of the breast of the gunman, i.e., target object. A photoelectric sensitive element 11 is fixed to said base plate 13 in such a manner that it is exposed to the front of the gunman through a lens 12 which is between the surface of the trunk body 5 and the photoelectric element 11.

Besides the afore-mentioned photoelectric sensitive element 11, electric parts are wired by printing on said base plate 13 to generate a signal from the photoelectric sensitive element 11 and to maintain the state of SWITCH ON for a certain period of time. A control terminal of the electric parts is connected to the wire ropes 10, 10*a* via the lead wire 14 and the terminal plate 15, whereby the wire ropes 10, 10*a* are put in the state of SWITCH ON or the state of short circuit for a certain period of time required to rotate an electric motor 18 so as to have disk 21, 21*a* make one revolution. A control device is thus composed.

A wire rope pulling device (B) is built in a stand box 16. A battery 17 and a driving case 20 are mounted in the stand box 16 and a power source switch 19 is projecting from the upper surface of the stand box 16. Disks 21, 21*a* are rotatably supported by a support axis mounted laterally through the case 20. An electric motor 18 mounted in the driving case 20 drives said disks 21, 21*a* via a speed reduction mechanism so that the disks 21, 21*a* may be turned in P direction shown by arrow in FIG. 1. Pulling arms 23, 23*a* are rotatably supported at the intermediate part by a supporting axis 22 and one end of the pulling arm is projected beyond the driving case 20. Clasps 25, 25*a* fixed to a base end of the wire rope 10, 10*a* are fastened to one end of the pulling arms 23, 23*a* by means of screws 26, 26*a*, and thus one end of the pulling arms 23, 23*a* is fastened to the wire ropes 10, 10*a*. The other end of the pulling arms 23, 23*a* is engaged with pins 24, 24*a* at about the circumferential part of the disks 21. 21*a*. Under this arrangement, when the pins 24, 24*a* disengage from the edge of the pulling arms 23, 23*a* by the rotation of the disks 24, 24*a* in P direction, the pulling arms 23, 23*a* suddenly change their rotation in Q direction (shown by arrow) and thus the wire ropes 10, 10*a* are put in loose state. Numerals 27, 27*a* in FIG. 2 designate insulating washers. Numeral 28 designates a lead wire to connect the power source switch 19 to the wire rope 10.

A shoe portion 1*a* of the first leg portion 1 is made in the shape of partial spherical body. A pedestal 29 to receive the shoe portion 1*a* therein is made partial spherical surface 29*a* toward the outside but flat surface 29*b* toward the inside so that the gunman is supported stably in its standing position but is not supported against falling down. Thus, the target object is ready to fall in any directions.

In the above embodiment, the wire ropes 10, 10*a* of the rope pulling device (B) are utilized as a part of lead wire of the control device and therefore the wire rope must be brass stranded wire, steel wire rope, etc. (or rope including metallic wire). However, if the lead wire and the conductor which connect the photoelectric element with an electric motor, a power source, etc. are arranged separately in the control device, rope made of synthetic resin, natural fiber, etc. can be used.

In the light emission gun shooting, when the mark was hit and light entered in the photoelectric element 11, the electric motor 18 works, by the functioning of the control device, for the duration in which the disks 21, 21*a* make one revolution. If the disks 21, 21*a* turn slightly and the pins 24, 24*a* assume their highest position and in turn disengage from the edge of the pulling arms 23, 23*a*, the pulling arms 23, 23*a* rotate in Q direction (shown by arrow) and the base portion of the wire ropes 10, 10*a* rises suddenly and as a result the wire ropes 10, 10*a* are put in loose state.

Figure 4:
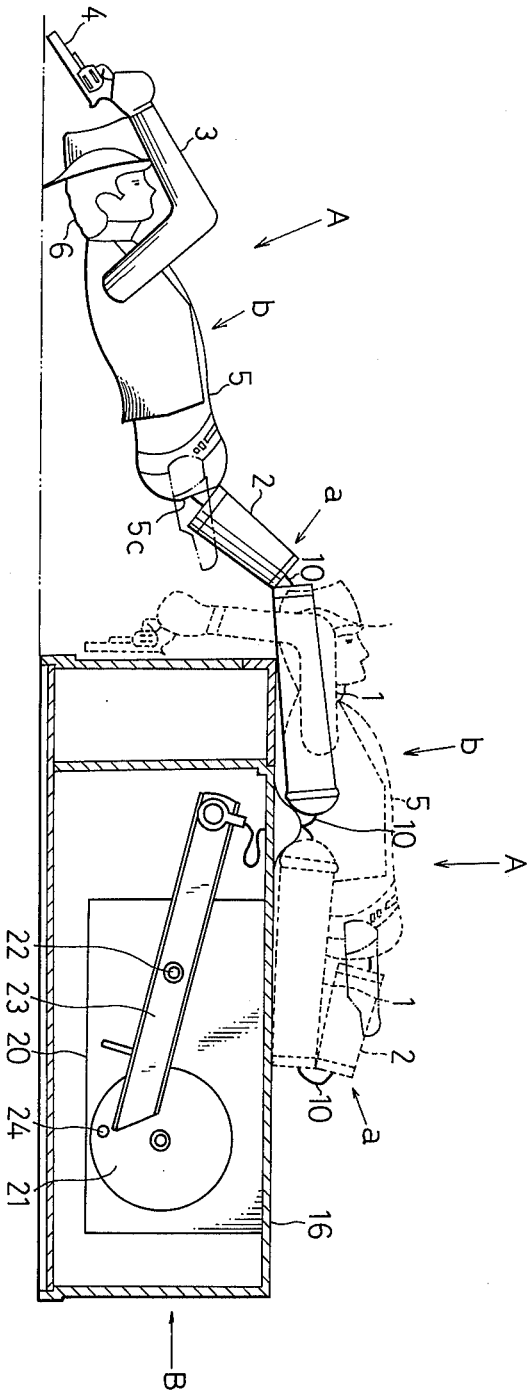
FIG. 4 is a side view of the target device with a target object fell backward.
Figure 5:
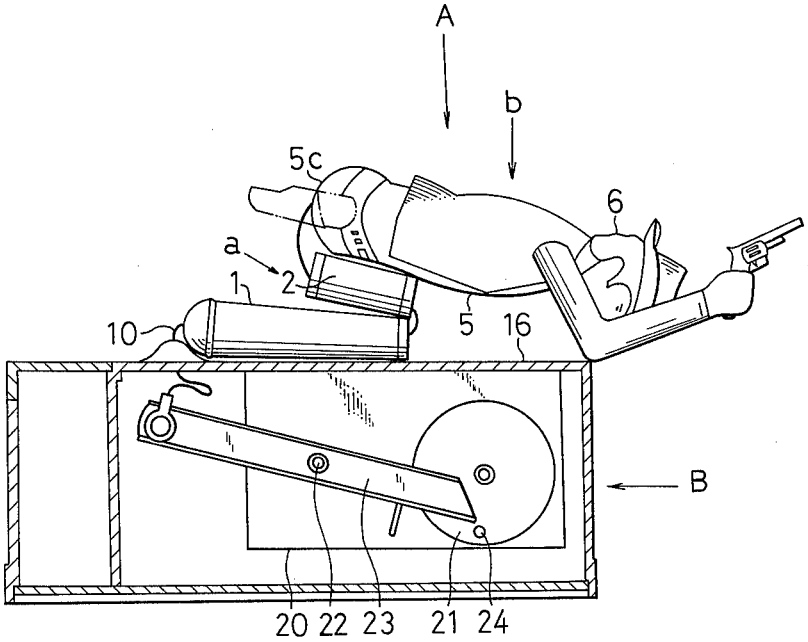
FIG. 5 is a side view of the target device with a target object fell forward.

By the loosening of the wire ropes 10, 10*a*, joints of segments (a joint between the upper surface of the stand box 16 and the first leg body 1, a joint between the first leg body 1 and the second leg body 2, and a joint between the second leg body 2 and the trunk body 5) are made movable against each other. Thus, the first leg body 1 and the second leg body 2 are bent and the trunk body 5 and the head body 6 fall down, namely, various directions of falling down such as the state of falling backward (FIG. 4), state of falling forward (FIG. 5) and other states of falling down will be obtained. Thus, the gunman falls down in a variety of directions, simulating the falling of a gunman in actual firing.

The target assembly (A) which fell down upon a successful shooting stands up slowly in the following way, namely, when the disks make a half turn and the pins 24, 24*a* engage again with the pulling arms 23, 23*a*, the pins 24, 24*a* push up the edge of the pulling arms 23, 23*a* and lower the othr end and thus tension is applied to the wire ropes 10, 10*a* gradually, as a result of which the target assembly (A) is made to rise gradually, ready for next shooting.

Figure 6:
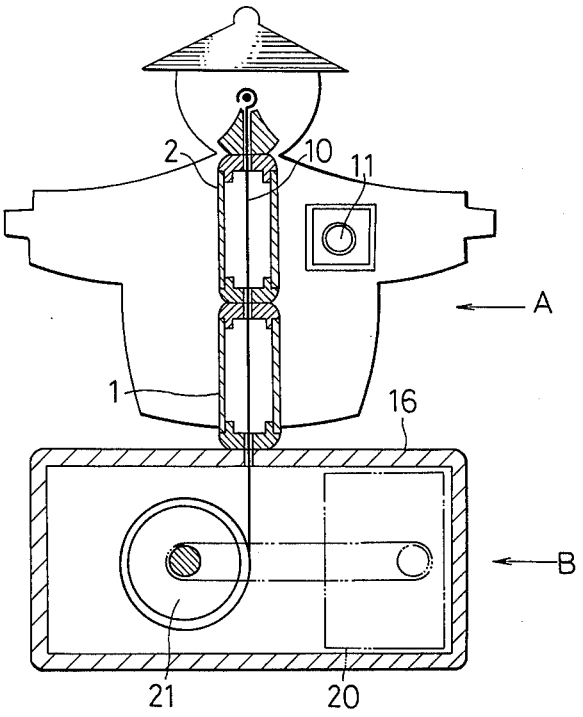
FIG. 6 is a schematic view of an embodiment in which a target object is single-legged.
Figure 7:
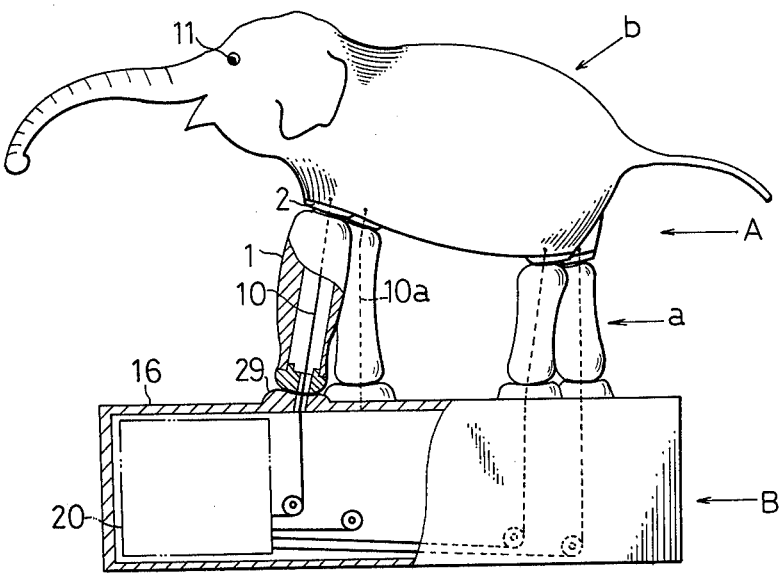
FIG. 7 is a schematic view of an embodiment in which a target object is four-legged.
Figure 8:
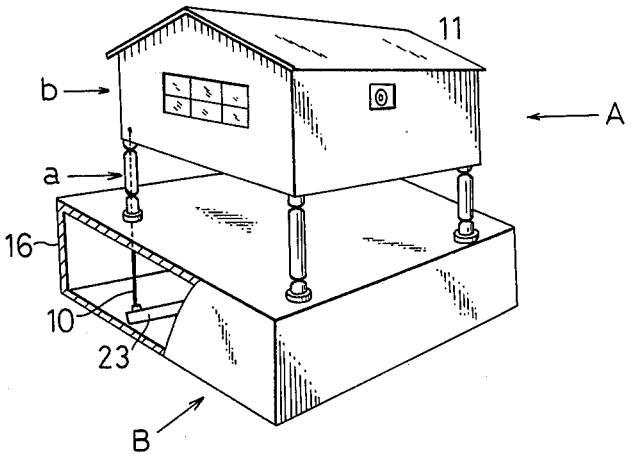
FIG. 8 is a schematic view of an embodiment in which a target object is a house.

In the embodiment, the target assembly (A) is a two-legged gunman but as shown in FIG. 6 it can be single-legged or can be four-legged as shown by FIG. 7 or can be a house as shown by FIG. 8. In short, any shape of target assembly can be used in the present invention, provided that the supporting segment changes from the standing state to the fell-down state by means of the loosening of the rope.

However, if it is so designed that the target assembly has two or more supporting segments for which individual wire ropes are used and the ropes are loosened individually by the rope pulling device, falling down of the target object upon a sucessful shooting will be made more diversified in the direction and in the shape.

As mentioned above, according to the present invention the target assembly is kept upright by tightening of the rope but whenever it is hit successfully, it falls down by loosening of the rope in different directions and in different positions as if it fell down in actual firing. Thus, the present invention makes the shooting game more realistic and entertaining and enhances the market value of the light emitting shooting apparatus for amusement.

I claim:

1. A target structure for a light emitting shooting apparatus for amusement of the type whereby a light beam, upon a successful shooting, enters into a photoelectric sensitive element from which a signal is generated to effectuate a control circuit to cause said target structure to fall down and display a "hit", wherein said target structure comprises;

a target assembly including at least one supporting segment and at least one target object, said supporting segment having a longitudinal through-hole through which a rope is passed and said target object being provided with a photoelectric sensitive element, thereby the target object taking a standing position, when the rope is in a tight state and taking a fell down position when the rope is loosened;

a rope pulling device which keeps a rope tight; and a control device for controlling said rope pulling device thereby the rope in tension being loosened in response to an output signal from the photoelectric element of the target segment, whereby when a shooter is ready for shooting, the supporting segment is caused to take a standing state by giving tension to the rope passing therethrough and when the mark is hit successfully the rope is loosened to cause the supporting segment to fall down and rendering the target object fell down, indicating a hit by the change of the position of the target object.

2. A target structure as claimed in claim 1, wherein an end of the rope is fixed to the target segment, a base end of the rope is fastened to an end of a pulling arm whose intermediate part is pivotally mounted on a case and a spring to work in the tightening direction of the rope is provided so that the rope is placed in a tight state by drawing the base end of the rope into a stand box when a pulling arm is assuming the position of standing-by, a pin which is fixed to the circumferential part of a rotor driven by an electric motor which rotates by a signal from the control device is engaged with a top end of said pulling arm so as to keep the pulling arm in a position of standing-by for a little while, whereby a target object is kept in a standing position for a certain period of time after the start of the operation of the control apparatus due to the hit and thus a time lag is caused between the hit of the mark and falling down of the target object and then the target object is caused to fall down suddenly by the disengagement between the pin and the pulling arm.

3. A target structure as claimed in claim 2, wherein in the state that the target object falls down due to disengagement of the pin from the pulling arm, after the rotor rotates for a certain period of time the pin and the pulling arm are engaged with each other at about the intermediate part of the pulling arm so that the position at which both are engaged is shifted slowly toward the top end position according to the rotation of the rotor and thus the pulling arm is rotated slowly to the standing-by position and accordingly the base end of the rope is drawn slowly into the case and is tightened slowly, thereby making the shooting target object stand up slowly.

4. A target structure as claimed in clain 1, wherein the supporting segment takes the shape of partially spherical body so that the direction in which the supporting segments falls down is made more irregular.

5. A target structure as claimed in claim 1, wherein the supporting segment is composed of one or more units each comprising a lower first leg body and an upper second leg body connected in vertical series so that the change of falling down posture is more diversified.

6. A target structure as claimed in claim 1, wherein the supporting segment is made hollow and has a through-hole in longitudinal direction, through which at least two conductive wire ropes are passed and said wire ropes are utilized as substitute for lead wires for connecting the photoelectic element or the control device to the electric motor and the power source, thereby eliminating the exposure of lead wire on the surface of the target object.

* * * * *